US005102380A

United States Patent [19]

Jacobson et al.

[11] Patent Number: 5,102,380

[45] Date of Patent: Apr. 7, 1992

[54] COOLING EXERCISE TREADMILL

[75] Inventors: David L. Jacobson, El Paso, Tex.; William T. Dalebout, Logan, Utah

[73] Assignee: Proform Fitness Products, Inc., Logan, Utah

[21] Appl. No.: 305,930

[22] Filed: Feb. 1, 1989

[51] Int. Cl.[5] ..... A63B 23/06

[52] U.S. Cl. ..... 482/54; 482/111

[58] Field of Search ..... 272/69, 70, 72, 73, 272/130, 97; 434/61

[56] References Cited

U.S. PATENT DOCUMENTS

| | | | |
|---|---|---|---|
| 3,606,320 | 9/1971 | Erwin, Jr. . | |
| 3,686,776 | 8/1972 | Dahl | 434/61 |
| 4,344,616 | 8/1982 | Ogden . | |
| 4,415,152 | 11/1983 | Smith | 434/61 |
| 4,580,983 | 4/1986 | Cassini et al. | 434/61 |
| 4,591,147 | 5/1986 | Smith . | |
| 4,643,418 | 2/1987 | Bart . | |
| 4,759,540 | 7/1988 | Yu et al. | 272/69 |

FOREIGN PATENT DOCUMENTS

| | | | |
|---|---|---|---|
| 1057928 | 5/1959 | Fed. Rep. of Germany | 272/69 |

OTHER PUBLICATIONS

Cross Country Shortcut—(Nordic Trak) The Washington Star/Mar. 30, 1980.

Nordic Trak Brochure, 2 pages.

*Primary Examiner*—Stephen R. Crow

*Attorney, Agent, or Firm*—Trask, Britt & Rossa

[57] ABSTRACT

A treadmill has a fan which is powered by treadmill motor to direct cooling air onto the user. The treadmill has a single post which may be rotated from an upright position to a storage position which is substantially in alignment with the endless belt and the support surface underneath the endless belt.

9 Claims, 3 Drawing Sheets

COOLING EXERCISE TREADMILL

BACKGROUND OF THE INVENTION

1. Field:

This invention relates to exercise equipment.

2. State of the Art:

Treadmills are a well-known class of exercise machines which are becoming more popular for use in a wide variety of environments.

Presently available treadmills are typically difficult to store because an upright structure is provided for the user to grasp while exercising on the treadmill. Such structure typically interferes with easy storage.

Also, treadmills are obviously stationary. Thus, the user does not receive the cooling benefit of moving air associated with physical movement while, in fact, jogging, walking or running around a track or in another environment. That is, stationary exercise performed on a treadmill does not have the benefit of cooling air which would be derived from the user's motion if the exercise were actually undertaken in real conditions.

SUMMARY OF THE INVENTION

A treadmill has a frame with a support surface mounted to the frame to support a user thereon. An endless belt is trained around guide means which are secured to the frame. The belt travels over the support surface. Propulsion means are associated with the guide means to supply rotational torque thereto and, in turn, to the endless belt. Blower means are also connected in a position to discharge air towards the user positioned on the endless belt as it passes over the support surface.

In a preferred arrangement the propulsion means includes a motor. The blower means includes a fan secured to one end of the motor for rotation thereby. The blower means also includes a volute positioned about the fan with the discharge oriented toward the user. Desirably, the treadmill includes a hood having aperture means formed therein to register with the discharge.

In an alternate embodiment, a treadmill includes a frame with a support surface to support a user. Guide means are mounted on opposite ends of the support surface with an endless belt trained thereabout. Propulsion means are associated with the guide means to supply rotational torque thereto. A trunnion is attached to the frame and extends upwardly therefrom. A post is mounted to the trunnion to be rotatable between a first position in which the post extends upwardly from the frame for use and a second position in which the post is displaced from said first position for storage. The post has handle means mounted for grasping by a user in an upright position on the belt.

In a preferred embodiment, the treadmill includes control means mounted proximate the upward end. The control means has control leads extending downwardly therefrom to the frame through the trunnion. The trunnion is formed for the leads to pass therethrough. Desirably the post is rectilinear in cross section from above said trunnion. The post further includes locking means to secure the post in the first position.

Desirably, the trunnion is formed to have a front side facing outwardly from the frame with left and right sides inwardly formed therewith. The post has a portion which extends over the front side. The locking means is operable to lock the portion extending over the front side to the front side of the trunnion.

Preferably, the locking means is a bolt which passes through the aperture formed in the portion of said post extending over the front side of the trunnion into a corresponding aperture formed in the front side of the trunnion The trunnion most preferably includes a shaft positioned rearwardly and upwardly. The post is mounted to rotate about the shaft.

In a highly preferred embodiment, the treadmill of the instant invention includes a blower arrangement and a trunnion and post arrangement as described above.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 1:
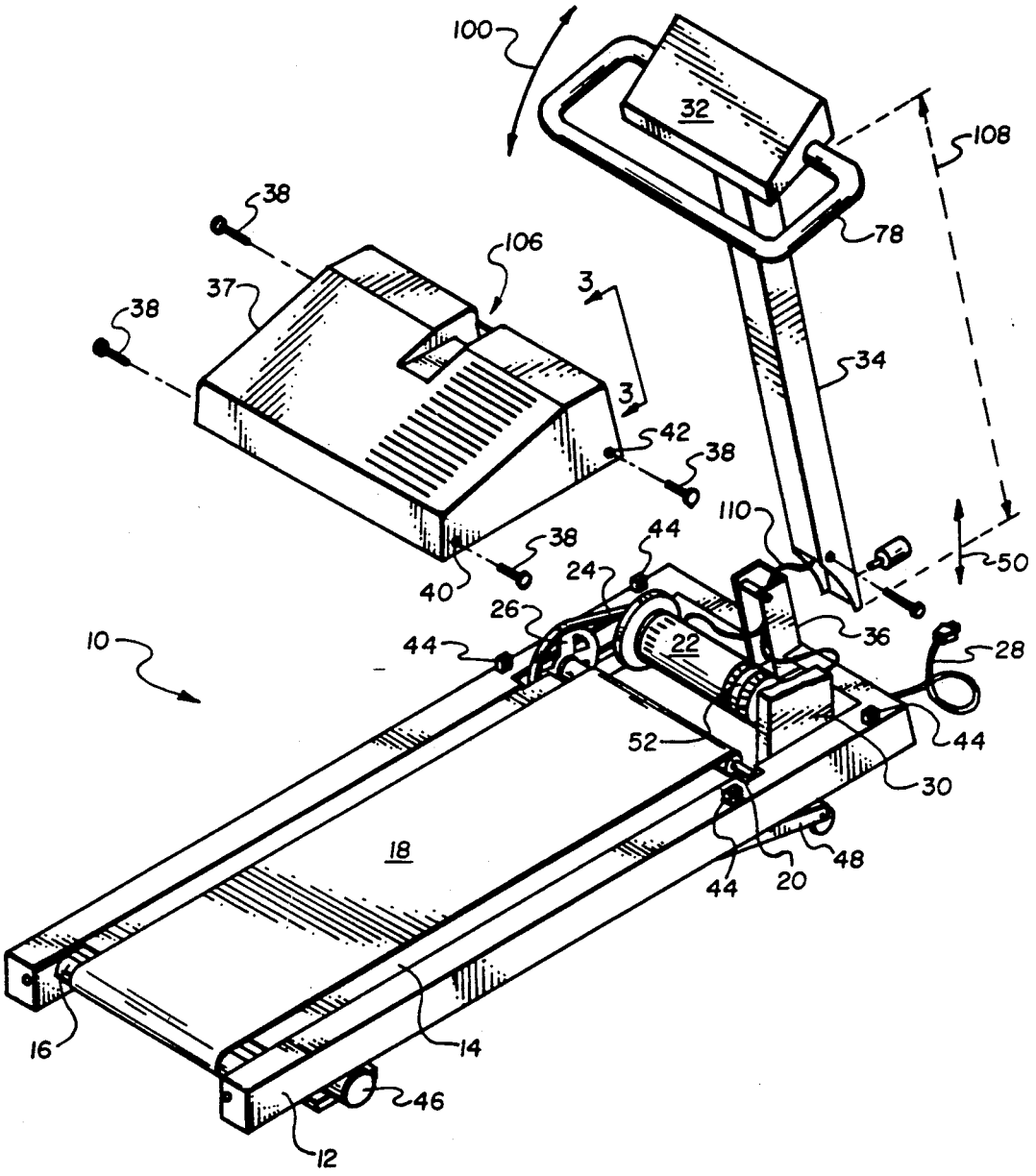
FIG. 1 is a partially exploded perspective view of the treadmill of the instant invention.

The treadmill 10 has a frame 12. A support surface 14 is mounted to the frame to support a user thereon. Guide means are mounted to the frame at opposite ends of the support surface to guide an endless belt which is trained around the guide means. As here shown, the guide means is a tail pulley 16 mounted to the frame 12 to rotate upon movement on the endless belt 18 which has an illustrated upper stretch which extends over the support surface 14. The guide means also includes a forward drive pulley 20 which is rotatably mounted for rotation by propulsion means as discussed hereinafter.

The propulsion means is connected to supply rotational torque to the guide means and, in turn, to the endless belt 18 which is trained around the guide means and more particularly the drive pulley 20 and the tail pulley 16. As shown in FIG. 1, the propulsion means includes a motor 22 which is connected to drive belt 24 which, in turn, is connected to a drive pulley 26. The pulley 26 is connected to rotate the forward drive pulley 20.

The motor 22 here shown is a typical AC motor powered by conventional 120 volts 60 AC power via cord 28. Those skilled in the art will recognize that other types of motors may be used including variable speed DC motors.

The treadmill of FIG. 1 also includes a controller 30 which is interconnected electrically to provide control signals, and, in turn, regulate the operation of the overall treadmill in accordance with operational signals received from a control panel 32 mounted to an upright post 34 which is affixed to the frame 12 by connection to a trunnion 36.

The treadmill 10 of FIG. 1 also includes a housing 37 which is connected to the frame by screws or bolts 38 through apertures 40 and 42 for further interaction with threaded connections or nuts 44 affixed to the frame 12. Frame 12 also includes a rear foot 46 and a front foot 48. The front foot 48 is operable by means (not shown) to raise and lower the height 50 of the treadmill 10 from its support surface to, in turn, increase the degree of difficulty being experienced by the user when exercising on the treadmill as more fully disclosed in U.S. patent application Ser. No. 256,486, filed Oct. 12, 1988 and now issued as U.S. Pat. No. 4,913,396.

Figure 2:
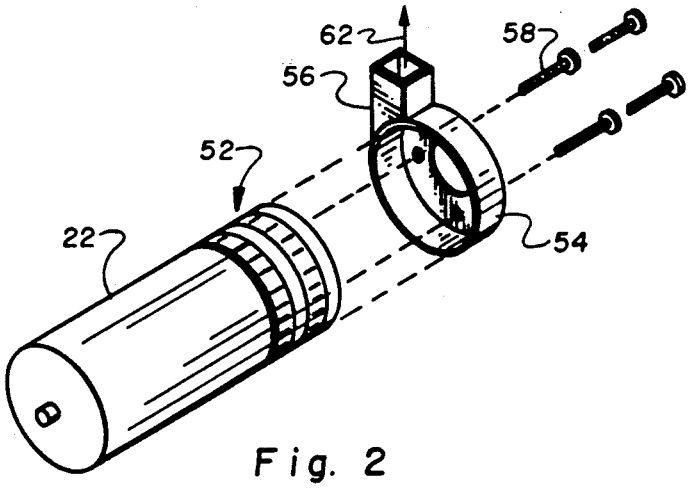
FIG. 2 is an exploded perspective view of a motor and a blower for use in the treadmill of FIG. 1.

FIG. 2 shows the motor 22 with a fan 52 integrally mounted to one end thereof. A volute 54 is connected to the motor 22 over the top of the fan 52 so that upon rotation of the motor and, in turn, the fan 52 air is discharged out of the discharge 56 of the volute 54. The motor 22 is connected to the volute by bolts 58 which interconnect into corresponding apertures (not shown) in the housing of the motor 22. Other alternate ways of securing the volute 54 to the motor 22 may be used as desired.

Figure 3:
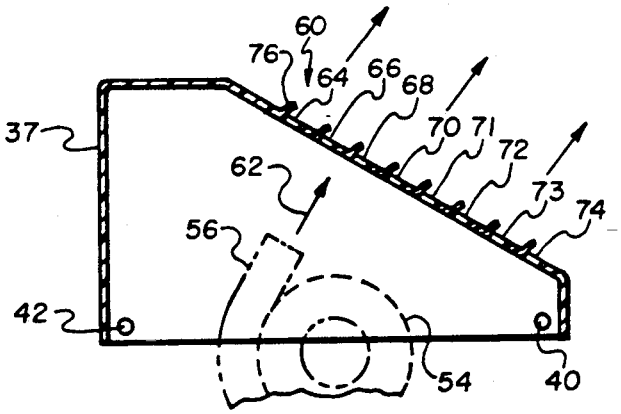
FIG. 3 is a cross section of a hood for use with the treadmill of FIG. 1.

In FIG. 3 the housing 37 of FIG. 1 cross section 3—3 is shown to illustrate the louver structure 60 formed in one side of the housing 37 to register with the discharge 56 of the volute 54. Air 62 exiting the volute 54 will be forced outwardly through a plurality of louver slots 64, 66, 68, 70, 71, 72, 73 and 74. Each of the louver slots has a directional vane 76 associated therewith to direct the air in the desired direction which is here selected to be towards an upright user positioned on the support surface 14 and more particularly on the endless belt 18 while grasping the handle 78 (FIG. 1) of the post 34. Operation of the fan 52 causes air to be brought inwardly through the bottom of the treadmill 10 to act as cooling air for the motor 22. The air circulates under the housing to cool components thereunder. It is then exhausted outwardly through the louvers 64 through 74. As a result, the user experiences a more natural feeling while exercising because an increased pace or speed causes the fan 52 to operate at a greater RPM and in turn discharge more air through the volute 54 and discharge 56 and further through the louvers 64–74 onto the user. In effect, the user experiences greater air flow when going faster the same as if the user were to be walking faster or running faster if in fact running on a hard surface such as a street.

Figure 4:
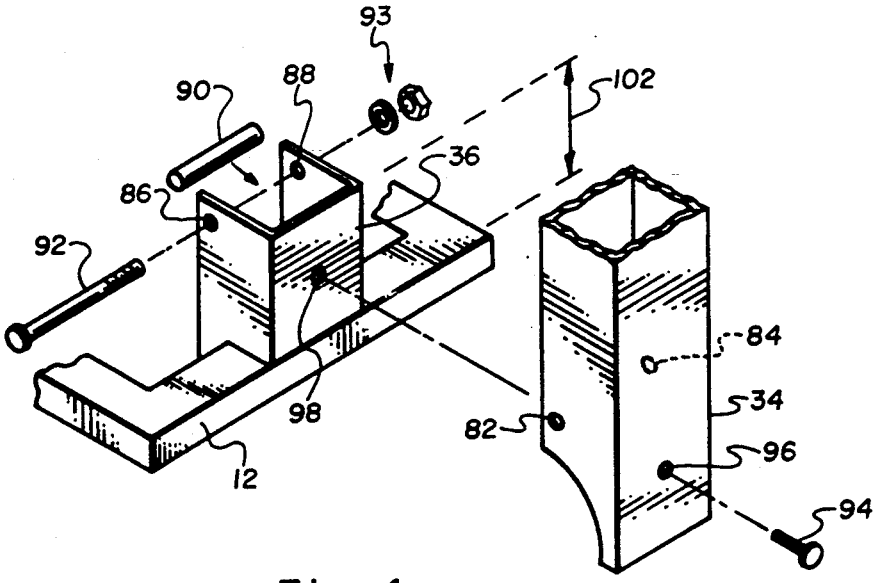
FIG. 4 is a partial perspective view of portions of the treadmill of FIG. 1.

FIG. 4 shows the front portion of the treadmill 10 in greater detail with the trunnion 36 being mounted to the frame 12. Desirably the trunnion 36 is made of a durable metal and in turn welded to the frame 12 which is also made of a similar durable metal. The post 34 has apertures 82 and 84 formed therein to register with similar apertures 86 and 88 formed in the trunnion 36. A shaft 90 is positioned in the trunnion to act not only as a spacer but also as a support structure through which axle 92 is positioned. That is, the axle 92 is positioned through the apertures 82, 84, 86 and 88 and is secured in place using a washer and nut arrangement 93.

Securing means or locking means are also provided to lock the post 34 to the trunnion 36. That is, a threaded bolt 94 is provided to pass through an aperture 96 to interract with a corresponding aperture 98 formed on the trunnion 36. A nut may be securely positioned behind the aperture 98 or the aperture 98 may be threaded as desired by the user. The post 34 is secured to the trunnion 36 by operation of the bolt 94 thus securing the post 34 in its upright position generally as illustrated in FIG. 1.

Figure 5:
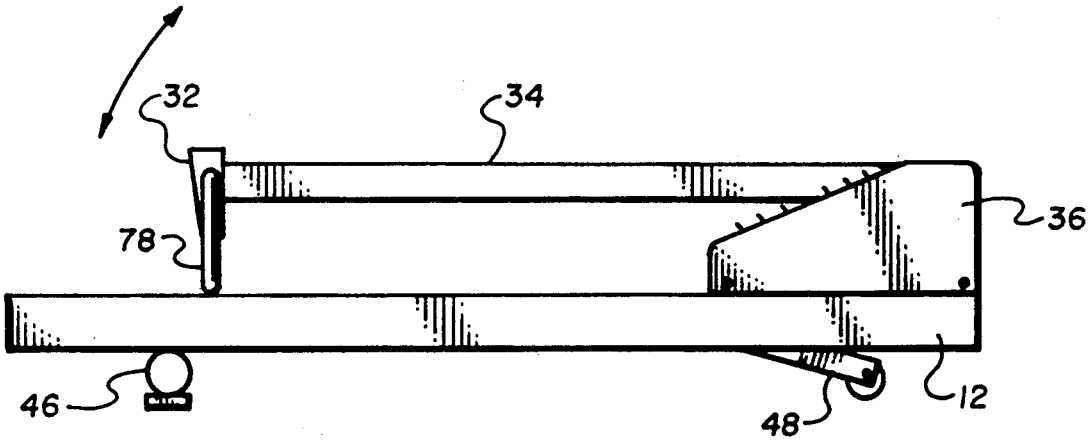
FIG. 5 is a side view of the treadmill of FIG. 1 with the post in a storage position.

The post 34 is rotatable to a position displaced from the upright position for purposes of storage. As shown in FIG. 5, the storage position is preferably one in which the post 34 is substantially in alignment with the support surface 14 and the endless belt 18. The bolt 94 can be unthreaded or removed allowing the post 34 to move in an arc 100 (FIG. 1) about the axle 92 (FIG. 1, FIG. 4). The height 102 of the trunnion (FIG. 4) and more particularly the axle 92 is selected so that with the post 34 in the storage position shown in FIG. 5, the handle 78 contacts the endless belt 18 so that the post 34 is in fact substantially in alignment with the frame 12 and in turn, the endless belt 18 as shown in FIG. 5. That is, the height 102 of the trunnion is selected so that the handle 78 will cause the post 34 to be spaced from the belt 18 a distance 104 (FIG. 5). It may be noted further that a slot 106 is formed in the housing 37 as shown in FIG. 1 so that post 34 may readily be moved between the upright position of FIG. 1 and the storage position of FIG. 5.

It may also be noted that the handle 78 is secured to the post 34 at a height 108 selected so that the user is in a position to comfortably grasp the handle 78 when exercising on the endless belt 18. The handle 78 also has control console 32 associated therewith which contains an on-off switch and any other desired controls and displays. The on-off switch is connected in the power line or conductors 110 between the motor 22 and the motor controller 30. The trunnion 36 is formed to receive the conductors 110 and have them pass therethrough. As shown in FIG. 1, the conductors 110 pass through the trunnion so that the post may be moved about the pin 90 and axle 92 without interference from the conductors 110.

In operation, the user is positioned on the treadmill 10 on a support surface. The user adjusts the height by operation of the front support structure 48. The treadmill 10 is energized causing the endless belt 18 to rotate about the pulleys 20 and 16. The user simultaneously may grasp the handle 78 for balance. As the machine operates, air is blown upward by the fan 52 through the louvers 60 up to the user. The post 34 is of course held in the upright position by the user operating the bolt 94 to secure the post 34 to the trunnion 36. After operation and performance of the desired exercises, the user may return the treadmill 10 to a storage configuration by undoing the bolt 94 and moving the post 34 to the storage position shown in FIG. 5.

It may be noted that the embodiments illustrated herein are merely illustrative of the application of the principles of the invention. Reference herein to details is not intended to limit the scope of the claims which themselves recite those features regarded as essential to the invention.

We claim:

1. A treadmill comprising:

a frame;

a support surface mounted to said frame to support a user thereon;

guide means mounted to said frame at opposite ends of said support surface for guiding an endless belt means;

said endless belt means trained about said guide means for movement thereabout and over said support surface;

motor means connected to said guide means to supply rotational torque thereto and in turn to said endless belt means;

blower means connected to be rotated by said motor means and positioned to discharge air towards a user positioned on said endless belt means over said support surface, said blower means including a fan secured to one end of said motor for rotation thereby, and a volute positioned about said fan and having a discharge;

a trunnion attached to said frame and extending upwardly therefrom;

a hood having apertures formed therein to register with said discharge from the volute; and a post mounted to said trunnion to be rotatable between a first position in which said post extends upwardly from said frame and a second position in which said post is displaced from said first position for storage; said post having an upward end to which handle means are mounted for graphing by a user in an upright position on said belt, said post being rectangular in cross section from above said trunnion, and said trunnion being formed to have a front side facing outwardly from the frame with left and right sides integrally formed therewith, wherein said post has a portion which extends over said front side; and locking means associated with said post and said trunnion, said locking means being operable to lock said portion to said front side.

2. The treadmill of claim 1 wherein said locking means is a bolt which threads through said portion into a corresponding aperture formed in said front side, wherein said trunnion includes shaft means positioned rearwardly and upwardly thereon and wherein said portion is mounted to rotate about said shaft means.

3. A treadmill comprising:

a frame;

a support surface mounted to said frame to support a user thereon;

guide means mounted to said frame at opposite ends of said support surface for guiding an endless belt means;

said endless belt means trained about said guide means for movement thereabout and over said support surface;

motor means connected to said guide means to supply rotational torque thereto;

a trunnion attached to said frame and extending upwardly therefrom, said trunnion being formed to have a front side facing outwardly from said frame;

a post mounted to said trunnion to be rotatable between a first position in which said post extends upwardly from said frame and a second position in which said post is displaced from said first position for storage, said post being formed to fit over said trunnion with a portion extending over said front side of said trunnion; and locking means associated with said post and said trunnion, said locking means being operable to lock said portion of said post to said front side.

4. The treatment of claim 3 wherein said locking means is a bolt which threads through said portion of said post into a corresponding aperture formed in said front side of said trunnion.

5. The treatment of claim 4 wherein said trunnion has left and right sides integrally formed with said front side.

6. The treatment of claim 5 wherein said trunnion includes shaft means positioned through said left and right sides and wherein said post is mounted to rotate about said shaft means.

7. The treatment of claim 6 wherein said post is rectilinear in cross section.

8. The treadmill of claim 7 wherein said post has an upper end to which handle means are mounted for grasping by a user in an upright position on said endless belt means.

9. The treadmill of claim 8 which said control panel has control leads extending downwardly therefrom through the post to said frame through said trunnion, said trunnion being hollow for said leads to pass therethrough.

* * * * *